United States Patent [19]

Ohya et al.

[11] Patent Number: 4,758,504

[45] Date of Patent: Jul. 19, 1988

[54] SILVER HALIDE GRAINS, LIGHT-SENSITIVE PHOTOGRAPHIC MATERIAL CONTAINING THE SAME AND METHOD FOR PREPARING SILVER HALIDE PHOTOGRAPHIC EMULSION CONTAINING THE SAME

[75] Inventors: Yukio Ohya; Syoji Matsuzaka; Yasuo Tosaka; Yoshihiko Suda, all of Hino, Japan

[73] Assignee: Konishiroku Photo Industry Co., Ltd., Tokyo, Japan

[21] Appl. No.: 945,306

[22] Filed: Dec. 22, 1986

[30] Foreign Application Priority Data

Dec. 26, 1985 [JP] Japan ..... 60-294484

[51] Int. Cl.[4] ..... G03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 4,284,717 | 8/1981 | Toya et al. | 430/567 |
| 4,497,895 | 2/1985 | Matsuzaka et al. | 430/569 |
| 4,683,192 | 7/1987 | Nishiyama | 430/569 |
| 4,684,607 | 8/1987 | Maskasky | 430/569 |

FOREIGN PATENT DOCUMENTS 0171238 12/1986 European Pat. Off. .

OTHER PUBLICATIONS

J. E. Maskasky, "The Seven Different Kinds of Crystal Forms of Photographic Silver Halides" Journal of Imaging Science, vol. 30, No. 6, Nov./Dec. 1986, pp. 247–254.

*Primary Examiner*—Mukund J. Shah

*Attorney, Agent, or Firm*—Frishauf, Holtz, Goodman & Woodward

[57] ABSTRACT

Disclosed are silver halide grains which have crystal faces defined by Miller indices of (nnl) where n≧2 and comprising a silver halide composition consisting substantially of silver chlorobromide; a light-sensitive silver halide photographic material having, on a support, light-sensitive silver halide emulsion layers at least one of which contain the above silver halide grains; and a method for preparing silver halide photographic emulsion containing the above silver halide grains having the steps of mixing a silver ion solution and a halide ion solution in the presence of a protective colloid and then forming and growing silver halide grains having a silver halide composition of 2 mole % or less of silver iodide, 1 to 99 mole % of silver chloride and 99 mole % or less of silver bromide, wherein the silver ion solution comprises an ammoniacal silver nitrate solution and formation and growing of the silver halide grains are carried out in the presence of at least one selected from the compounds represented by the formula (I), (II), (III) or (IV) shown below and the compounds having the recurring units represented by the formula (V) shown below:

Formula (I)

Formula (II)

Formula (III)

Formula (IV)

Formula (V)

wherein $R_1$, $R_2$ and $R_3$, which may be either the same or different, each represent a hydrogen atom, a halogen (Abstract continued on next page.)

atom, a hydroxyl group, an amino group, a derivative of an amino group, an alkyl group, a derivative of an alkyl group, an aryl group, a derivative of an aryl group, a cycloalkyl group, a derivative of a cycloalkyl group, a mercapto group, a derivative of an mercapto group or —CONH—$R_4$ ($R_4$ is a hydrogen atom, an amino group, a derivative of an alkyl group, a derivative of an amino group, a halogen atom, a cycloalkyl group, a derivative of a cycloalkyl group, an aryl group or a derivative of an aryl group), $R_1$ and $R_2$ may be bonded together to form a ring, $R_5$ represents a hydrogen atom or an alkyl group, X represents a monovalent group formed by eliminating one hydrogen atom from the compounds represented by the formula (I), (II), (III) or (IV), and J represents a divalent linking group.

8 Claims, 6 Drawing Sheets

SILVER HALIDE GRAINS, LIGHT-SENSITIVE PHOTOGRAPHIC MATERIAL CONTAINING THE SAME AND METHOD FOR PREPARING SILVER HALIDE PHOTOGRAPHIC EMULSION CONTAINING THE SAME

BACKGROUND OF THE INVENTION

This invention relates to light-sensitive silver halide grains suitable for rapid development and extremely less in fogging and light-sensitive silver halide photographic materials containing said grains, and a method for preparing silver halide photograhic emulsions containing said grains, which are less fogging and have high sensitivity compared with the grain diameter.

In recent years, light-sensitive photograhic materials are required to improve various characteristics, and particularly, in the light-sensitive materials for color paper, etc., it has been required to have high aptitude for rapid processings which can result an image having high sensitivity and desired gradation with short time in order to improve efficiency of a developing processing step.

Further, as the high-sensitivity photographic emulsion used for light-sensitive materials for photography such as a film for X-ray, color negative film, etc., there has been employed primarily a silver iodobromide emulsion having relatively large grains.

As a high sensitivity emulsion, silver iodobromide emulsions containing 0 to 10 mol % of iodine are well known in the art. And, as the methods for preparing these emulsions, there have been known the methods in which pH condition and pAg condition are controlled such as the ammoniacal method, the neutral method, the acidic method, etc. and the mixing methods such as the single jet method, the double jet method, etc.

On the basis of these known techniques, in order to accomplish further higher sensitization, improvment of graininess, high sharpness and low fog, very precise technical means have been investigated and practically applied. In the silver iodobromide emulsion, studies have been made even about the emulsions controlled in concentration distributions of iodine within the individual silver halide grains, to say nothing of crystal habits and grain size distribution.

The most orthodox method for accomplishing photographic performances such as high sensitivity and low fog density is to improve the quantum efficiency of a silver halide. For this purpose, the knowledges about solid physics have positively been applied. The study having calculated theoretically the quantum efficiency and speculating about the effect of grain size distribution is disclosed in, for example, the pretext of Tokyo Symposium concerning Progress in Photography in 1980, entitled "Interactions between Light and Materials for Photographic Applications", on page 91. According to this study, it is predicted to be effective for improvement of quantum efficiency to prepare a monodispersed emulsion by narrowing the grain size distribution. In addition, for accomplishing sensitization of a silver halide emulsion, in the step of chemical sensitization as described hereinafter in detail, it may be considered resonable to estimate that a monodispersed emulsion would be advantageous for accomplishing efficiently high sensitivity while maintaining low fogging. The monodispersed emulsion is an emulsion in which grain size distribution of silver halide microcrystalline constituting the emulsion is extremely narrow and it is uniform in characteristics other than the grain diameter such as, for example, physical properties, photographic performances, etc. within the grains, and is suitable for obtaining high photographic performances.

For preparation of a monodispersed emulsion in industry, it is necessary to control the feeding rate of silver ions and halogen ions to the reaction system theoretically determined under sufficient stirring conditions, on the basis of pAg and pH strictly controlled, as disclosed in Japanese Provisional Patent Publication No. 48521/1979. The silver halide emulsions prepared under these conditions comprise the so-called normal crystal grains having (100) faces and (111) faces having either cubic, octahedral or tetradecahedral shapes at various proportions. And, higher sensitization has been known to be possible with such normal crystal grains.

For preparation of a monodispersed emulsion, various methods have further known, for example, as disclosed in Japanese Patent Publication No. 36896/1973, Japanese Provisional Patent Publication Nos. 99419/1979, 77737/1980, 49938/1983 and 46640/1984. As can be seen from these descriptions, since silver iodobromide has low solubility and slow in grain growing speed, ammonia has usually been employed as a silver halide solvent to obtain an emulsion having a large grain size.

Silver bromide or silver iodobromide has a property that progress of development is inherently slow so that it is difficult to correspond to rapid processing required for a color paper, etc. Thus, silver chlorobromide emulsion which has rapid in progress of development has preferably been used. Further, in the light-sensitive material forming an image on a reflective support such as a color paper, etc., it is important characteristics to express clean white and also extremely low in fogging is indispensable so that these facts make difficult to select an emulsion.

According to the above situation, as the light-sensitive material for forming an image on a reflective support, it is considered that a monodispersed silver chlorobromide emulsion which is, in particular, lowered the fogging is the most preferred one which comply with the objects. Since the silver chlorobromide is relatively high in solubility and has rapid in grain growth, it is not necessary to use a silver halide solvent during grain formation, and the preparation thereof has hitherto been carried out by the so-called boiling method wherein mixing a halide ion solution and a silver nitrate solution.

As a silver chlorobromide emulsion improved in characteristics, there has been disclosed in Japanese Patent Publication No. 72737/1980 a silver halide photographic material containing silver chlorobromide grains which comprise rhombododecahedron having (110) crystal face, but it cannot satisfy the presently required performances for a light-sensitive material. Further, by an emulsion comprising silver chlorobromide grains having conventionally known various crystal forms, satisfied performances could not be obtained.

Further, in addition to fogging and sensitivity, it has been required to more improve with respect to various characteristics such as stability during preservation, prevention of fogging during high-temperature preservation, and the like. According to the characteristics of the silver chlorobromide obtained by the conventional method, it has been difficult to satisfy these requirements.

SUMMARY OF THE INVENTION

An object of the present invention is to provide silver chlorobromide grains and a light-sensitive silver halide photographic material using said grains which are excellent in sensitivity-fog relationship, high in sensitivity, extremely low in fogging and suitable for rapid processing.

Another object of the present invention is to provide a method for preparing a silver halide emulsion, particularly, a monodispersed silver chlorobromide emulsion which is extremely low in fogging, and excellent in photographic characteristics such as sensitivity, preservability, etc. which is difficult to obtain by the conventional method.

As a result of verious investigations, the present inventors have found that the above objects have accomplished by silver halide grains having crystal faces defined by Miller indices of (nn1) (wherein $n \geqq 2$) and comprising a silver halide composition consisting substantially of silver chlorobromide and a light-sensitive silver halide photographic material having at least one light-sensitive silver halide emulsion layer containing said grains on a support.

Also, the present inventors have further made intensive studies, and as a result, the above object can be accomplished by a method for preparing silver halide emulsions containing said grains, wherein mixing a silver ion solution and a halide ion solution in the presence of a protective colloid to form and grow up silver halide grains having a silver halide composition of 2 mole % or less of silver iodide, 1 to 99 mole % of silver chloride and 99 mole % or less of silver bromide, the improvement comprises said silver ion solution is an ammoniacal silver nitrate solution and said forming and growing up of the silver halide grains is carried out in the presence of at least one compound selected from the group consisting of the compounds represented by the following formula (I), (II), (III) and (IV) shown below and the compounds having the recurring units represented by the formula (V) shown below:

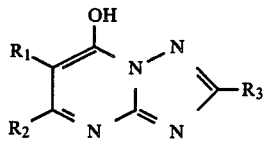

Formula (I)

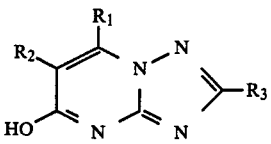

Formula (II)

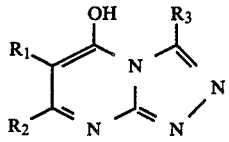

Formula (III)

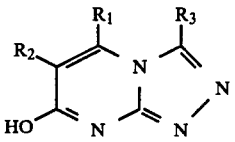

Formula (IV)

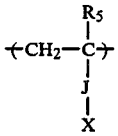

Formula (V)

wherein $R_1$, $R_2$ and $R_3$, which may be either the same or different, each represent a hydrogen atom, a halogen atom, a hydroxyl group, an amino group, a derivative of an amino group, an alkyl group, a derivative of an alkyl group, an aryl group, a derivative of an aryl group, a cycloalkyl group, a derivative of a cycloalkyl group, a mercapto group, a derivative of a mercapto group or —CONH—$R_4$ ($R_4$ is a hydrogen atom, an alkyl group, an amino group, a derivative of an alkyl group, a derivative of an amino group, a halogen atom, a cycloalkyl group, a derivative of a cycloalkyl group, an aryl group or a derivative of an aryl group), $R_1$ and $R_2$ may be bonded together to form a ring (for example, a carbon ring of 5 to 7 membered or a heterocyclic ring), $R_5$ represents a hydrogen atom or an alkyl group, X represents a monovalent group formed by eliminating one hydrogen atom from the compounds represented by the formula (I), (II), (III) or (IV) (for example, those formed by eliminating one hydrogen atom from $R_1$ to $R_3$ or OH group of the aforesaid compounds represented by the formulae (I) to (IV)), and J represents a divalent linking group.

PREFERRED EMBODIMENTS OF THE INVENTION

First, silver halide grains having (nn1) face in accordance with the present invention will be explained.

Figure 1:
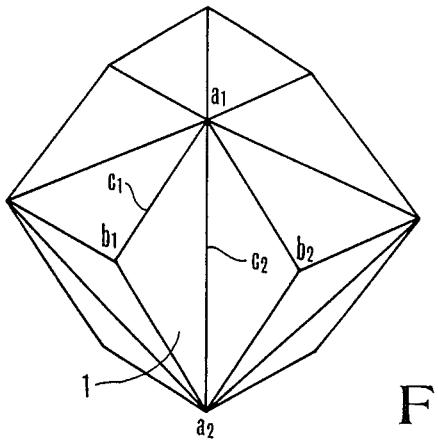
FIGS. 1 to 8 are illustrations showing the respective crystal forms of silver halide grains having (nn1) faces of the present invention.
Figure 2:
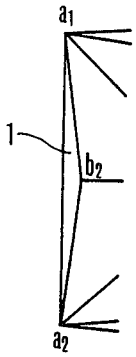

FIG. 1 is a drawing showing the whole shape of the silver halide crystal outer surface of which is constituted by (nn1) crystal faces only. Also, FIG. 2 is a side view of FIG. 1 viewed from the direction of straight lines of $b_1$ and $b_2$. Equivalent crystal faces represented by (nn1) crystal faces exist 24 faces. Therefore, the crystal in which all of its ourter surface is constituted by (nn1) crystal faces takes a form of trisoctahedron and each plane constituting the outer surface becomes an obtuse-angle triangle. There are two kinds of vertexes. That is, there are 6-vertex equivalent to $a_1$ and 8-vertex equivalent to $b_1$ in FIG. 1. At the vertex $a_1$, eight planes share borders and at the vertex $b_1$, three planes share borders. As to edges, there also exist two kinds. That is, there are 24 edges $c_1$s which are equivalent to edge $a_1b_1$ and 12 edges $c_2$s which are equivalent to edge $a_1a_2$ in FIG. 1.

Figure 3:
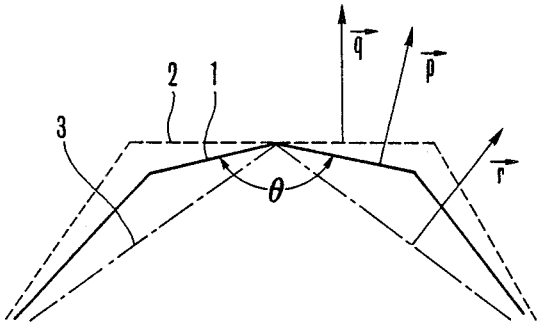

Next, by using a sectional view, relationship between (nn1) face, (111) face and (110) face will be explained. A sectional view at a plane d containing a segment $b_1b_2$ of the trisoctahedron in FIG. 1 and perpendicular to the triangle $a_1a_2b_1$ and to the triangle $a_1a_2b_2$ is shown with solid line 1 in FIG. 3. That is, in FIG. 3, the solid line 1 shows a crossing line of the plane d and the (nn1) face. On the other hand, a broken line 2 shows (110) face and a dashed line 3 shows (111) face, and directions of the (nn1) face, (110) face and (111) face are shown by single normal vectors $\vec{p}$, $\vec{q}$ and $\vec{r}$, respectively. That is, they are represented by $\vec{p}=[nn1]$ (wherein n is a natural number and $n \geqq 2$), $\vec{q}=[110]$ and $\vec{r}=[111]$. $\theta$ is an angle formed by two (nn1) crystal faces which are adjacent to the edge $a_1a_2$ as a border and it satisfies $110° < \theta < 180°$ in view of the limitations of $n \geqq 2$ and n being a natural number.

The (nn1) face intersects two axes among three axes of the crystal axes at the same distance from the origin, and intersects the remaining axis with slight inclination since they are not parallel. Thus, it can be represented by (11 1 /n), and accordingly it has been represented by (nn1).

According to the above, it is definite that the (nn1) crystal face according to the present invention is quite different from the (111) crystal face and the (110) crystal face which are conventionally known in the silver halide fine crystals at all. Further, it would not be necessary to explain that it is also different from the (100) crystal face.

On the other hand, in Japanese Providional Patent Publication No. 83531/1986 (which corresponds to U.S. Ser. No. 758,550 and EP-A-17 238), there is disclosed "a silver iodobromide grain having crystal face having ridgeline at the center of the (110) face". In that specification, this crystal face is called as semi-(110) face and described that "the angle between the two semi-(110) faces of the roof-type commonly possessed by the ridgeline may be more obtuse than 110°". That is, the semi-(110) face has the same meaning as (nn1) crystal face according to the present invention (wherein $n \geqq 2$ and n is a natural number).

Figure 4:
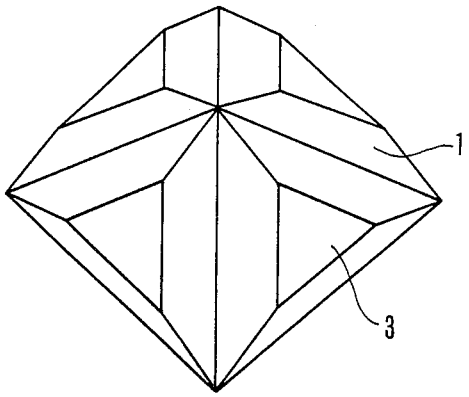
Figure 5:
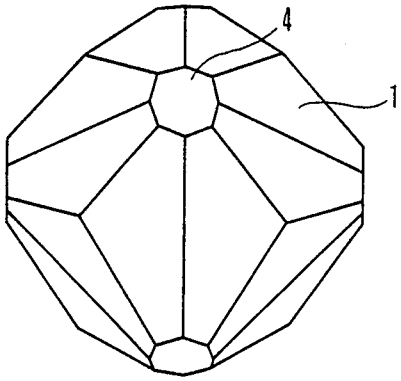
Figure 6:
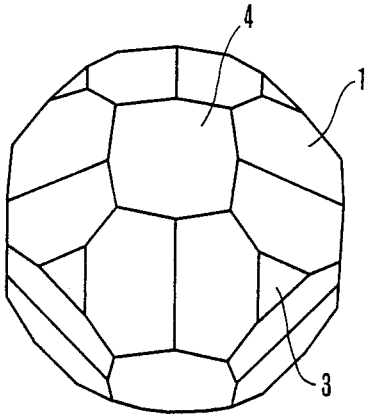
Figure 7:
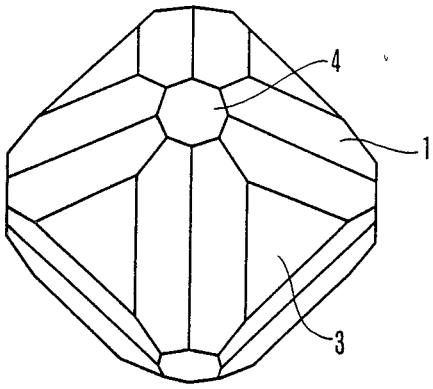
Figure 8:
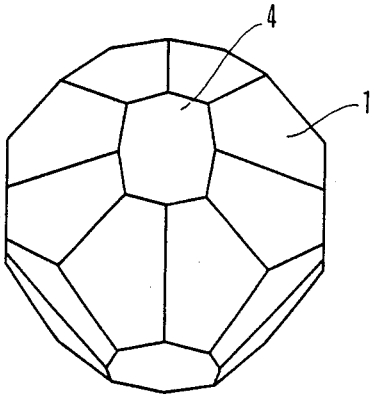
Figure 9:
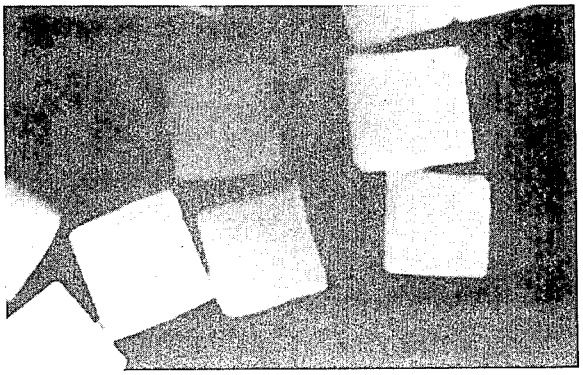
FIG. 9 is a electron microscopic photograph of the silver halide grain for comparative purpose.
Figure 10:
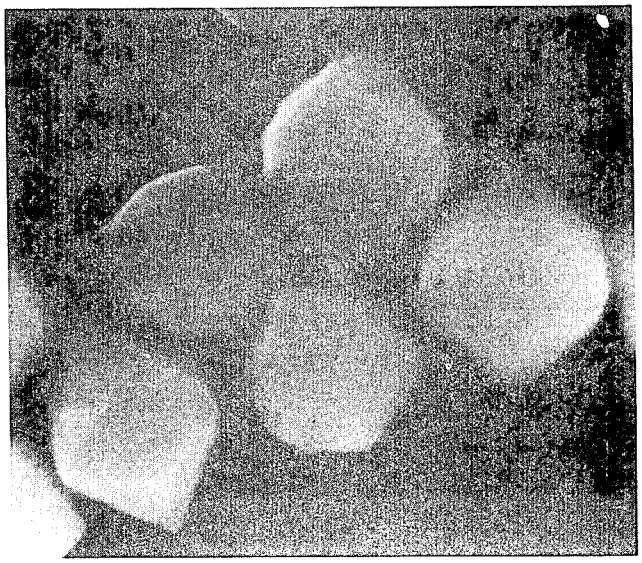
FIGS. 10 to 13 are electron microscopic photographs of the silver halide grains of the present invention.
Figure 11:
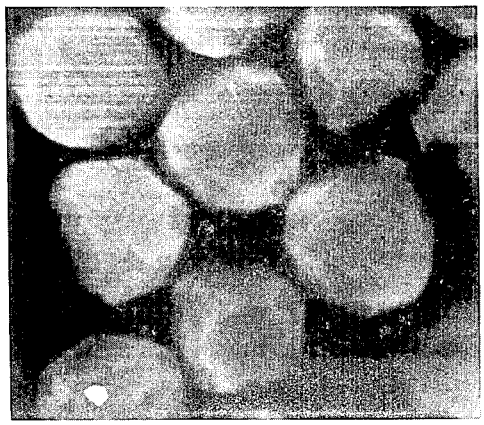
Figure 12:
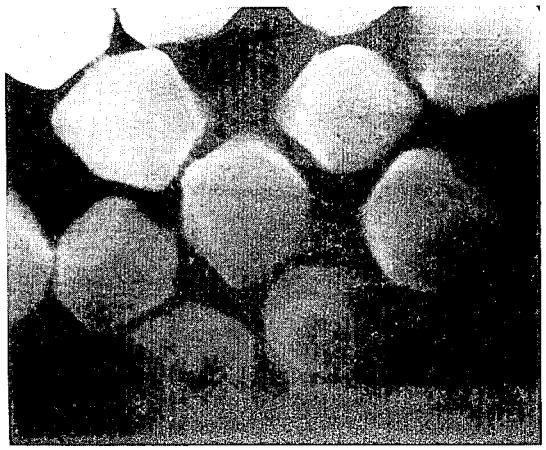
Figure 13:
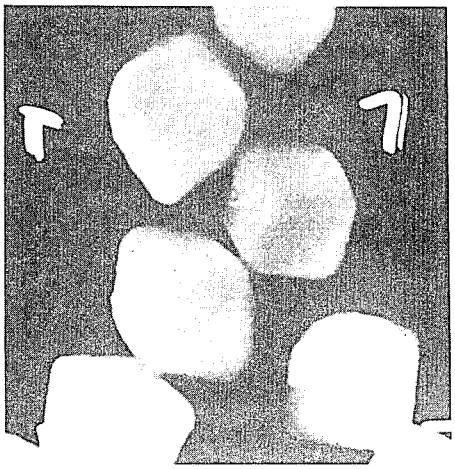

In the silver halide grains according to the present invention, all the outer surfaces are not necessarily constituted by the (nn1) faces. That is, (111) face, (100) face or (110) face may exist. Examples of these are shown in FIGS. 4 to 11. By mixedly existing the (111) face or (100) face, the silver halide grains may take a form of trisdecahedron (FIGS. 5 and 8), octatridecahedron (FIGS. 6 and 7) or tetraoctahedron (FIG. 4).

The silver halide grains according to the present invention are crystals having (nn1) face on their ourter surfaces, which may be either normal crystals or twin crystals (including multiple twins). Said grains include those corresponding to at least one item of the following items (1) to (3) in crystal forms.

(1) The proportion of the surface area of (nn1) faces to the total surface area is at least 30%. In determination of this proportion, when the boundary between the two crystal faces is unclear (for example, because the boundary has a roundness, etc.), the line of intersection of these two faces is determined as the boundary.

(2) To belong to the scope of the crystal forms as shown in the electron microscope photographs in FIGS. 9 to 13 given below.

(3) To belong to the scope of the crystal forms as shown in FIGS. 1 to 8 given below wherein.

In the silver halide composition of the silver halide grains according to the present invention, "consisting substantially of silver chlorobromide" means that other silver halides than silver bromide and silver chloride, for example, silver iodide, may be contained within the range which does not interfere with the effect of the present invention. More specifically, in the case of silver iodide, its proportion should desirably be 2 mole % or less.

The proportion of silver chloride in the silver halide grains according to the present invention should preferably be 1 to 99 mole %, and the proportion of silver bromide should preferably be 99 mole % or less.

The grain size of the silver halide grains according to the present invention is not particularly limited, but the present invention is at least effective preferably within the range from 0.1 to 3.0 μm. In the present specification, the grain size of the silver halide refers to the length of one side of the cubic body which is equal to its volume.

The silver halide grains according to the present invention are generally prepared and used in the form dispersed in a dispersing medium such as gelatin, namely the form called as emulsion. The grain size distribution of the group of said grains may be either monodispersed or polydispersed, and may also be a distribution wherein these are mixed, which can be selected suitably depending on the uses.

The method of preparing the silver halide grains according to the present invention is not particularly limited, but in the step of forming silver halide grains by mixing a solution of a water-soluble silver salt and a solution of a water-soluble halide in the presence of a protective colloid, the pAg of the emulsion is controlled at 8.0 to 9.5 within a certain period of time, and during this period at least one compound selected from the compounds represented by the formulae (I), (II), (III) or (IV) and the compounds having the recurring units represented by the formula (V) are incorporated in the above emulsion. Among the compounds represented by the formulae (I), (II), (III) and (IV), the compound represented by the formula (I) is most preferred.

In the above formulae (I) to (IV), the alkyl group represented by $R_1$ to $R_4$ may include, for example, a methyl group, an ethyl group, a propyl group, a pentyl group, a hexyl group, an octyl group, an isopropyl group, a sec-butyl group, a t-butyl group, a 2-norbornyl and the like; the derivative of alkyl group may include, for example, alkyl groups substituted with an aromatic residue (which may be bonded through a divalent linking group such as —NHCO—, etc.) (e.g. a benzyl group, a phenethyl group, a benzhydryl group, a 1-naphthylmethyl group, a 3-phenylbutyl group, a benzoylaminoethyl group, etc.), alkyl groups substituted with an alkoxy group (e.g. a 2-methoxymethyl group, a 2-methoxyethyl group, a 3-ethoxypropyl group, a 4-butoxybutyl group, etc.), alkyl groups substituted with a halogen atom, a hydroxy group, a carboxy group, a mercapto group, an alkoxycarbonyl group or a substituted or unsubstituted amino group (e.g. a monochloromethyl group, a hydroxymethyl group, a hydroxyethyl group, a 3-hydroxybutyl group, a carboxymethyl group, a 2-carboxyethyl group, a 2-(methoxycarbonyl-)ethyl group, an aminomethyl group, a diethylaminomethyl group, etc.), alkyl groups substituted with a cycloalkyl group (e.g. a cyclopentylmethyl group, etc.), alkyl groups substituted with a monovalent group formed by eliminating one hydrogen atom from the compounds represented by the above formulae (I) to (IV), and so on.

The aryl groups represented by $R_1$ to $R_4$ may include, for example, a phenyl group, a 1-naphthyl group and the like, and the derivative of an aryl group may include, for example, a p-tolyl group, an m-ethylphenyl group, an m-cumenyl group, a mesityl group, a 2,3-xylyl group, a p-chlorophenyl group, an o-bromophenyl group, a p-hydroxyphenyl group, a 1-hydroxy-2-naphthyl group, an m-methoxyphenyl group, a p-ethoxyphenyl group, a p-carboxyphenyl group, an o-(methoxycarbonyl)phenyl group, an m-(ethoxycarbonyl)phenyl group, a 4-carboxy-1-naphthyl group, etc.

The cycloalkyl group represented by $R_1$ to $R_4$ may include, for example, a cycloheptyl group, a cyclopentyl group, a cyclohexyl group, etc. and the derivative of a cycloalkyl group may include, for example, a methyl-cyclohexyl group, etc. The halogen atom represented by $R_1$ to $R_4$ may be, for example, fluorine, chlorine, bromine and iodine. The derivative of an amino group represented by $R_1$ to $R_4$ may be exemplified by a butylamino group, a diethylamino group, a anilino group, etc. The derivative of a mercapto group represented by $R_1$ to $R_3$ may include, for example, a methylthio group, an ethylthio group, a phenylthio group, etc.

The alkyl group represented by $R_5$ may preferably have 1 to 6 carbon atoms such as a methyl group, an ethyl group, etc.

$R_5$ is particularly preferred to be a hydrogen atom or a methyl group.

J is a divalent linking group, having preferably 1 to 20 total carbon atoms. Of such linking groups, those represented by the formula (J - I) or (J - II) shown below are preferred.

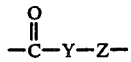

(J-1)

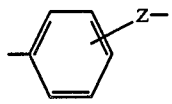

(J-II)

In the above formulae, Y represents —O— or

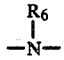

(wherein $R_6$ is a hydrogen atom or an alkyl group having 1 to 6 carbon atoms); and Z represents an alkylene group (having preferably up to 10 carbon atoms, optionally having an intermediary amide linkage, an ester linkage or an ether linkage therein, as exemplified by a methylene group, an ethylene group, a propylene group, $—CH_2OCH_2—$, $—CH_2CONHCH_2—$, $—CH_2CH_2COOCH_2—$, $—CH_2CH_2OCOCH_2—$, $—CH_2NHCO—\ CH_2—$, etc.), —O-alkylene group, —CONH-alkylene group, —COO-alkylene group, —OCO-alkylene group or —NHCO-alkylene group (these alkylene groups having preferably up to 10 carbon atoms) or an arylene group (having preferably 6–12 carbon atoms, such as a p-phenylene group, etc.).

The divalent linking group particularly preferred as J may include the following: $—CONHCH_2—$, $—CONHCH_2CH_2—$, $—CONHCH_2OCOCH_2—$, $—CONHCH_2CH_2CH_2—OCOCH_2—$, $—COOCH_2—$, $—COOCH_2CH_2—$, $—COOCH_2CH_2OCOCH_2—$, $—COOCH_2CH_2CH_2OCOCH_2—$ and

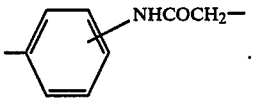

The compound having the units represented by the formula (V) may be either a homopolymer or a copolymer, and the copolymer may include, for example, a copolymer of monomers such as acrylamide, methacrylamide, an acrylate, a methacrylate, etc.

In the following, typical examples of the compounds represented by the above formula (I), (II), (III) or (IV) or the compounds having the recurring units represented by the above formula (V) (hereinafter referred to as tetraazaindene compounds to be used in the present invention) are enumerated.

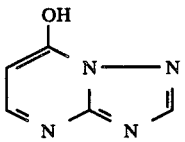

(1)

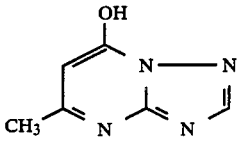

(2)

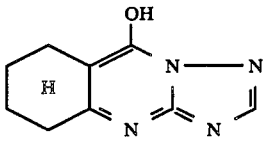

(3)

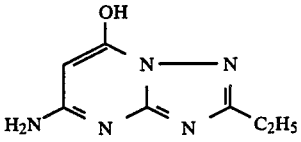

(4)

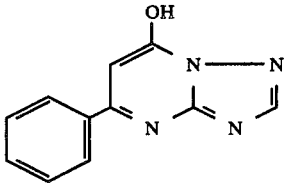

(5)

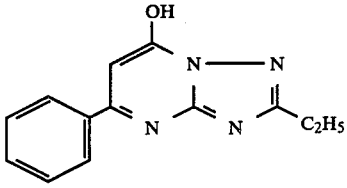

(6)

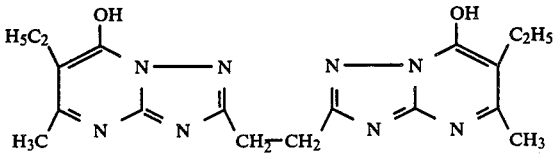

(7)

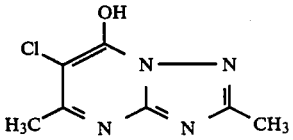

(8)

-continued
(9)
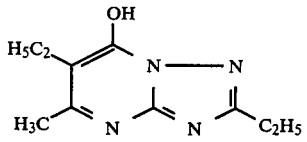
(10)
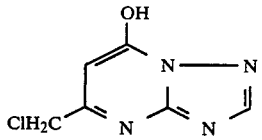
(11)
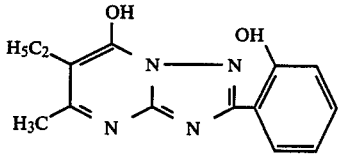
(12)
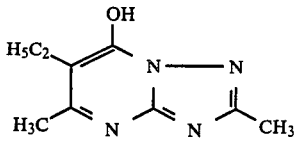
(13)
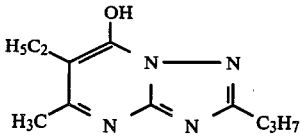
(14)
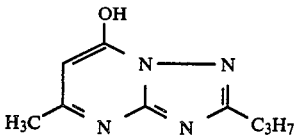
(15)
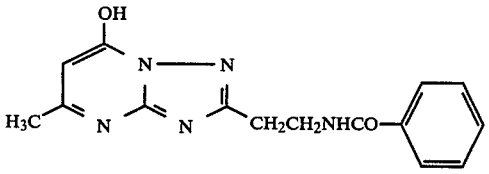
(16)
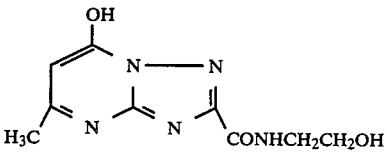
(17)
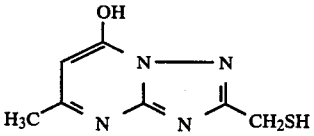
(18)
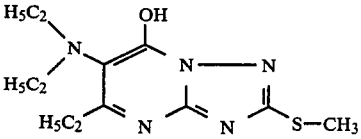
(19)
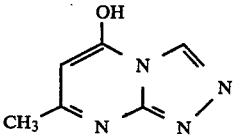
(20)
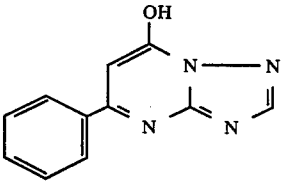
(21)
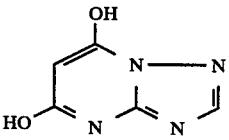
(22)
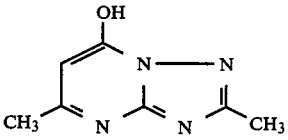
(23)
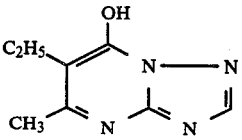
(24)
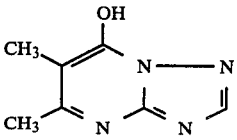
(25)
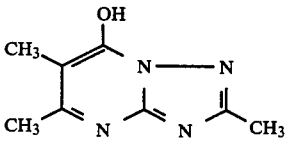
(26)
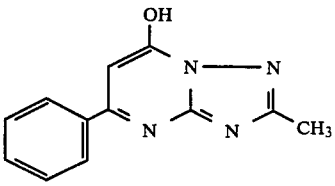
(27)
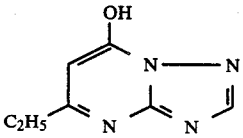
(28)
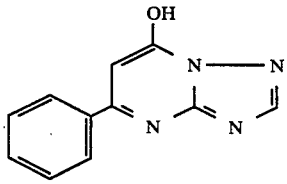

-continued (29)

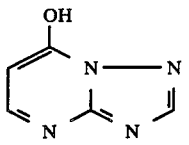

(30)

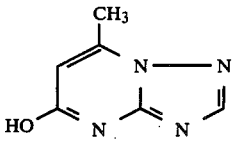

(31)

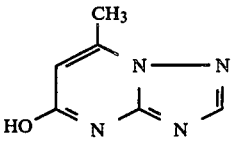

(32)

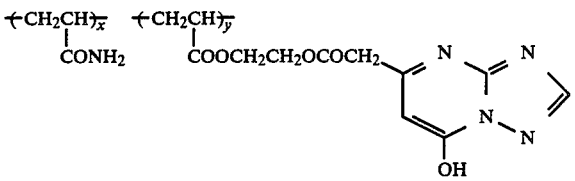

Copolymer of y: 5 to 50 mole %.

(33)

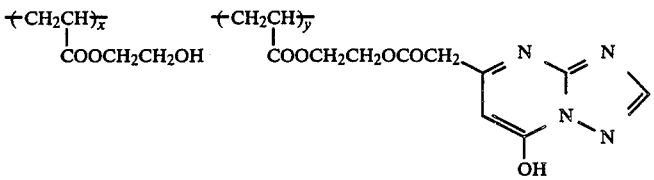

Copolymer of y: 5 to 50 mole %.

(34)

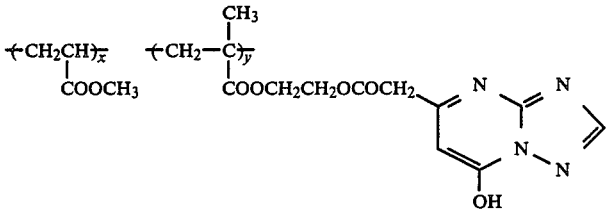

Copolymer of y: 5 to 50 mole %.

(35)

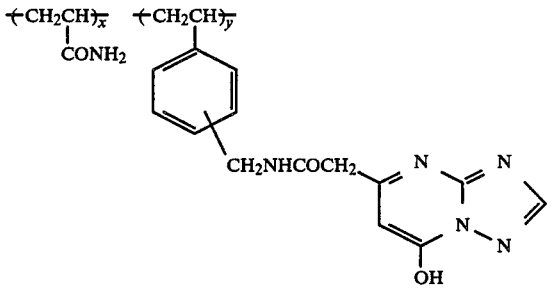

Copolymer of y: 5 to 50 mole %.

(36)

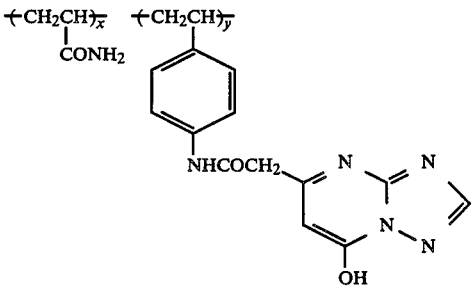

Copolymer of y: 5 to 50 mole %.

The above specific tetraazaindene compound according to the present invention should previously be presented in a mother liquor during formation of the silver halide emulsion and the amount thereof should preferably be increased in accordance with formation and growth of the silver halide grains. Accordingly, the specific tetraazaindene compound should preferably be added into a mother liquor of mixed emulsion, and a halide ion solution (herein after referred to a halide solution) or an ammoniacal silver nitrate solution. Also, by preparing the specific tetraazaindene compound solution of the present invention separately to the above solutions, and pouring into an emulsion with a halide solution and/or an ammoniacal silver nitrate solution are preferred method. However, in practical, it is most preferred that the specific tetraazaindene compound is added into a mixed mother liquor and a halide solution in view of simplification of the steps and heightening productivity. By varying an amount of the specific tetraazaindene compound supplementing to the mixed mother liquor and during grain growth of the silver halide grains, history of crystal habits during grain growth of the silver halide crystal and a shape (crystal habits) of the finally prepared grains can be controlled.

The tetraazaindene compound to be used in preparation of the silver halide grains of the present invention may be added in an amount, which may differ depending on the preparation conditions such as the desired silver halide grain size, composition of the silver halide, temperature of the emulsion, pH, pAg and the like, may preferably be within the range from $10^{-5}$ to $2\times10^{-1}$ mole per mole of the total silver halide to be formed.

When the tetraazaindene compound is a compound having the recurring units represented by the formula (V), the moles of the tetraazaindene moiety is reckoned as the amount added.

In the method of the present invention, the silver halide emulsion can be prepared by mixing the halide solution and the ammoniacal silver nitrate solution in the presence of the above tetraazaindene compound, and the amminiacal silver nitrate solution herein mentioned means a solution prepared by adding equivalent amount or more of ammonia to a silver nitrate aqueous solution to form a silver-ammine complex solution. In case where ammoniacal silver nitrate is employed, at a moment that the solution is added to the mixed solution, an amount of the silver-ammine complex is overwhelmingly large and a free silver ion concentration is far little as compared with the case where the silver nitrate solution is directly added to so that formation of silver oxide becomes extremely little. Therefore, metal silver would not be formed by the reduction of the silver oxide and thus potent inhibition effect of generation of fog can be obtained combined with the effect due to the above tetraazaindene compound.

On the other hand, when an ammoniacal silver nitrate solution is employed, the pH of the solution becomes high since large amounts of ammonia are introduced into the mixed solution of the silver ion solution and the halide solution. However, when the formation of emulsion containing silver chloride is carried out under the conditions of so high pH, fog will sometimes increase. Therefore, the pH of said mixed solution at the stage of mixing of the above ammoniacal silver nitrate solution and the halide solution should preferably maintain 10 or less, more preferably within the range of 6 to 9.5.

In order to maintain the pH within the above conditions, it can be employed the method in which a suitable amount of an acid is previously added to a protective colloid solution which is a mother liquor of the mixed solution of the ammoniacal silver nitrate solution and the halide solution, and/or the halide solution, or the method in which a solution of an acid is continuously or intermittently added to the mixed solution with the progress of mixing. As the acid to be used as adjustment of pH, there may be employed various acidic materials, for example, an inorganic acid such as sulfuric acid and nitric acid; and an organic acid such as acetic acid and citric acid.

In the method of the present invention, crystal habits, shape, etc. of the silver halide grains obtained are varied depending upon the amount of tetraazaindene compound existing during formation of silver halide grains as described above, crystal habits, grain size distribution and shape of the silver halide fine crystal are also depending upon an silver ion concentration in the solution during formation of fine crystal, i.e., pAg strongly, as described in many literatures such as Journal of Photograhic Science, Vol. 12, pp. 242 to 251 (1964) and ibid., Vol. 27, pp. 47 to 53 (1979).

In the method of the present invention, it is preferred to maintain the pH of the mixed solution within the range of 4 to 9 at the mixing stage of the ammoniacal silver nitrate solution and the halide ion solution. The pAg may be maintained at a constant value within the above range during whole period of the mixing depending upon the crystal habits, shape, grain size distribution, etc. of the grains of the silver halide emulsion to be obtained, and may be varied during the procedure of addition of the silver ion solution as described in Japanese Provisional Patent Publication No. 46640/1984. As the method for controlling the pAg, it is preferred the method using a mixed solution of an aqueous bromide ion and an aqueous chloride ion as a pAg controlling solution. That is, in view of pAg controllerability, monodispersibility of the resulting grains and composition of halogen, it is preferred that an amount of the halide ion to be added per unit time during mixing is to be made substantially equivalent to an added amount of the silver ion, and at the same time, the aforesaid pAg controlling solution comprising an aqueous bromide ion and an aqueous chloride ion is added to the mixed solution with the addition ratio shown by the following formula whereby the pAg value is controlled.

$$Y=KX$$

wherein X is a Cl/Br (molar ratio) ratio of the formed silver halide and K is a positive number of 40 to 1200.

Further, the value of K should preferably be, depending upon the temperature of an emulsion mother liquor forming and suspending silver halide, a number within the range obtained by the following formula:

$$K=(634.9-12.75t+0.07938t^2)S$$

wherein t is a temperature (°C.) of an emulsion mother liquor forming and suspending a silver halide and S is a positive number of 3 to $\frac{1}{3}$.

For formation of an emulsion, the halide ion solution (the second solution) is so added as to become an amount of halide ion is substantially equivalent to an amount of silver ion in the silver ion solution (the first solution) to be added. The above pAg controlling solution is added by adjusting its concentration and/or addition rate so as to make the change in the pAg sufficiently little. When the addition rate of the pAg controlling solution is close to that of the second solution, concentration of the pAg controlling solution should preferably be 1/10 or less of the total halide ion concentration of the second solution. When the addition rate can be set within 1/10 or less of that of the second solution, it may be equivalent to the halide ion concentration of the second solution.

For controlling the above addition rate, a technique for flow controlling usually employed can be utilized.

A preferred temperature for formation of the silver halide of the present invention is 30° to 80° C., more preferably 40° to 70° C.

As a protective colloid according to the present invention, water-soluble high-molecular materials, for example, natural or synthetic high-molecular materials such as gelatin or polyvinyl alcohol, may be employed singly or in combination.

The method of the present invention is effective for preparing an emulsion comprising silver halide grains of trisoctahedral, trisdecahedral, tetraoctahedral and octatridecahedral each having (nn1) faces. It is also effective for the preparation of elumsions comprising so-called core/shell type grains having discontinuous structure, to say nothing of emulsions having uniform composition in the silver halide grains and emulsions compositions of which are continuously changed in the grains.

The present invention is also effective for preparing so-called monodispersed emulsions having extremely narrow grain size distribution, to say nothing of the preparation of the polydispersed emulsions having wide grain size distribution. Here, the monodispersed emulsion means, when a variation coefficient is defined as shown below:

$$\text{Variation coefficient (\%)} = \frac{\text{Standard deviation of grain size of silver halide grains}}{\text{Average grain diameter of silver halide grains}} \times 100$$

the variation coefficient of 20% or less, and in view of characteristics, 15% or less is more preferred.

When the monodispersed emulsion is prepared according to the present invention, it is preferred that fine silver halide grains (so-called seed emulsion) separately prepared are previously added to a mother liquor containing protective colloids, and then an ammoniacal silver nitrate solution and a halide ion solution are added thereto in the presence of a tetraazaindene compound to grow up said seed emulsion grains to a desired grain size. Preparative conditions of seed grains to be used at this time are not particularly limited.

The silver halide grains of the present invention may be used as it were or may be used by blending two or more having different average grain diameters at an optional time after formation of the grains so as to obtain a desired gradation. In addition to the above, they may be used by mixing with other silver halide grains than the present invention.

As a binder of the silver halide grains according to the present invention or a dispersing medium to be used for preparation of said grains, hydrophilic colloids conventionally used for silver halide emulsions may be employed. The hydrophilic colloid may include not only gelatin (treated with either lime or acid), but also gelatin derivatives, polymer-grafted products of gelatin, synthetic hydrophilic polymeric materials, natural hydrophilic macromolecular substances other than gelatin, etc. These materials can be used either singly or as a mixture.

These silver halide emulsions may be chemically sensitized by using an active gelatin; a sulfur sensitizer; a selenium sensitizer; a reducing sensitizer; a noble metal sensitizer; etc., either singly or in optional combination (for example, in combination with a gold sensitizer and a sulfur sensitizer; in combination with a gold sensitizer and a selenium sensitizer, etc.).

The silver halide emulsions of the present invention may be carried out a chemical aging treatment by adding a sulfur-containing compound and at least one of a hydroxytetraazaindene and at least one of a nitrogen-containing heterocyclic compound having a mercapto group may be added before the chemical aging, during aging or after aging.

The silver halide of the present invention may be optically sensitized by adding suitable sensitizing dyes in an amount of $5\times10^{-8}$ to $3\times10^{-3}$ mole per mole of silver halide in order to provide a sensitivity to a desired light-sensitive wave-length region. Various sensitizing dyes may be employed and each sensitizing dye may by used singly or in combination therewith. Combination of sensitizing dyes is often used particularly for hypersensitization.

The silver halide grains according to the present invention may effectively applicable for light-sensitive photographic materials for various uses, such as black-and-white in general, X-ray, color, infrared, microphotography, silver dye bleaching, reversal, diffusion transfer, etc.

The emulsion containing the silver halide grains of the present invention can have abundant latitude by mixing at least two emulsions having different average grain diameters or different sensitivities or by providing in multiple layers.

The silver halide grains of the present invention can be applied for a light-sensitive photographic material for color by employment of the method and the materials conventionally used for light-sensitive materials for color by incorporating a combination of cyan, magenta and yellow couplers in the emulsions containing the silver halide grains according to the present invention controlled to red-sensitive, green-sensitive and blue-sensitive.

In the emulsion layers of a color light-sensitive material using the silver halide grains of the present invention, couplers, i.e., compounds capable of forming a dye by reacting with an oxidized product of a color developing agent may be contained.

As the above couplers, conventionally known yellow couplers, magenta couplers and cyan couplers may be used. These couplers may be diequivalent type or tetraequivalent type couplers, and a diffusive dye releasing type coupler, etc. may be used in combination with these couplers.

In order to add these couplers into the silver halide emulsions, when the coupler is alkali-soluble, they may be added as an alkalic solution. When the coupler is oil-soluble, it is preferred that the coupler is dissolved in a high-boiling point solvent and if necessary, in combination with a low-boiling point solvent, and dispersing in the form of fine particle to add into the silver halide emulsion. At this time, other hydroquinone derivatives, UV-absorbers, fading preventives may be used, if necessary. Further, two or more kinds of couplers may be used mixedly.

In the emulsion of the present invention, in addition to the aforesaid various functional materials, various additives for photography may be included. For example, antifoggants, stabilizers, UV-absorbers, color stain preventives, fluorescent brighteners, color image fading preventives, antistatic agents, film hardeners, surfactants, plasticizers, wetting agents, and so on.

As a support for the light-sensitive photographic material using the silver halide emulsions of the present invention, there may be selected one suitably depending on the purpose of use of the respective light-sensitive materials from those conventionally used, for example, baryta paper; polyethylene-coated paper; polypropylene synthetic paper; a transparent support having a reflective layer or using a reflective body such as glass; cellulose acetate; cellulose nitrate; polyester film such as polyethylene terephthalate; polyamide film; polycarbonate film; polystyrene film and others.

For providing the emulsion layers and other constituent layers of the light-sensitive material using the silver halide emulsion of the present invention, various coating methods such as dipping coating, ari-doctor coating, curtain coating, hopper coating, etc. may be employed.

In the present invention, coating position of each emulsion layers may optionally be set. For example, in case of the light-sensitive material for full color printed paper, a layer constitution successively from the support side, a blue-sensitive silver halide emulsion layer, a green-sensitive silver halide emulsion layer and a red-sensitive silver halide emulsion layer is preferred.

As to the processing method of the light-sensitive photographic material using the silver halide grains according to the present invention, there is no specific limitation and any processing methods can be applied.

EXAMPLES

The present invention is described in detail by referring to the following Examples, by which the present invention is not limited at all.

Seed emulsions to be used commonly in Examples will be firstly described.

Preparation of Seed Emulsion

According to the method as described in Japanese Provisional Patent Publication No. 45437/1975, silver chlorobromide emulsions NE - 1 to NE - 4 as shown in Table 1 were prepared. Each emulsion contains 1.413 mole of silver chlorobromide per liter of the emulsion.

TABLE 1

| Seed emulsion No. | AgBr/AgCl (molar ratio) | Average grain diameter* (μm) | Crystal habit | Preparative method |
|---|---|---|---|---|
| NE - 1 | 90/10 | 0.14 | cubic | acidic |
| NE - 2 | 50/50 | 0.15 | " | " |
| NE - 3 | 15/85 | 0.17 | " | " |
| NE - 4 | 100/0 | 0.10 | " | " |

*based on length of a side of a cube.

EXAMPLE 1

Silver chlorobromide emulsions comprising 50 mole % of silver bromide and having an average grain diameter of 1.0 μm and (nn1) faces on their surfaces were prepared.

Grain growth was carried out two steps since the grains were huge having final grain diameter of 1.0 μm.

(1) First grain growth

| | |
|---|---|
| [Solution 1 - A] | |
| Ossein gelatin | 54.4 g |
| Distilled water | 6236 ml |
| Polyisopropylene-polyethyleneoxy-disuccinic acid ester sodium salt 10% ethanolic aqueous solution | 6.5 ml |
| 56% Acetic acid aqueous solution | 28 ml |
| $NH_4OH$ | 1.76 mole |
| 4-Hydroxy-6-methyl-1,3,3a,7-tetra-azaindene | 225 mg |
| Seed emulsion NE - 2 | 264 ml |
| [Solution 1 - B] | |
| Ossein gelatin | 48.0 g |
| KBr | 428.4 g |
| NaCl | 210.3 g |
| Polyisopropylene-polyethyleneoxy-disuccinic acid ester sodium salt 10% ethanolic aqueous solution | 4.8 ml |
| Exemplary compound (2) | 822 mg |
| Made up to 2400 ml with addition of distilled water. | |
| [Solution 1 - C] | |
| $AgNO_3$ | 1223 g |
| Distilled water | 672 ml |
| $NH_4OH$ | 15.12 mole |
| Made up to 2400 ml with addition of distilled water. | |
| [Solution 1 - D] | |
| KBr | 0.474 g |
| NaCl | 58.3 g |
| Made up to 1000 ml with addition of distilled water. | |
| [Solution 1 - E] | |
| 56% Acetic acid solution | 2000 ml |

At 40° C., by means of a mixing stirrer as disclosed in Japanese Patent Publication Nos. 58288/1983 and 58289/1983, the solution 1 - A was mixed with the solution 1 - B and the solution 1 - C according to the double jet method. The addition rate of the solution 1 - C was increased like a polygonal line with lapse of time as shown in Table 2. Further, between the addition of each solution, pAg of the mixed solution was controlled to 8.4 by using the solution 1 - D, and by using the solution 1 - E, pH of the mixed solution was so controlled as to decrease with lapse of time as shown in Table 2. The control of the addition rates of the solutions 1 - B, 1 - C, 1 - D and 1 - E was carried out by using a flow rate variable roller tube pump.

Two minutes after completion of the addition of the solution 1 - B and the solutoin 1 - C, pH of the emulsion was adjusted to 6.0 with addition of the solution 1 - E. Then, washing and desalting of the emulsion were carried out by the following procedures. To the emulsion were added 913 ml of 5% aqueous Demol N (trade name, produced by Kao Atlas K.K.) and 691 ml of 20% aqueous mangesium sulfate solution to cause aggregation of the emulsion, and the aggregate was sedimented by allowed to stand. Subsequently, the supernatant was decanted and 15375 ml of distilled water was added thereto in order to disperse again. Then, 541 ml of 20% aqueous magnesium sulfate solution was added to the emulsion to cause aggregation again and the aggregate was sedimented, followed by decantation of the supernatant. To the aggregate was added 1000 ml of an aqueous solution of ossein gelatin (containing 80 g of ossein gelatin) and the mixture was stirred at 40° C. for 20 minutes to form dispersion and the total amount was made 5000 ml with addition of distilled water.

This emulsion had a grain diameter of 0.40 μm as a result of grain diameter measurement due to the grain sedimentation method. This emulsion is hereinafter called as EM - 8.

TABLE 2

| Addition time (min) | Addition rate of solution 1-C (ml/min) | pH |
|---|---|---|
| 0 | 25.2 | 8.50 |
| 4.4 | 61.9 | 8.42 |
| 6.6 | 96.4 | 8.34 |
| 8.3 | 117.3 | 8.26 |
| 9.7 | 134.3 | 8.18 |
| 11.0 | 150.0 | 8.10 |
| 12.1 | 164.6 | 8.02 |
| 13.2 | 177.9 | 7.94 |
| 14.1 | 182.5 | 7.86 |
| 15.1 | 179.4 | 7.78 |
| 16.1 | 173.7 | 7.70 |
| 17.2 | 166.2 | 7.62 |
| 18.9 | 152.9 | 7.50 |

(2) Secondary growth

By using the above EM - 8 as the seed emulsion, it was grown up to 1.0 μm.

| | |
|---|---|
| [Solution 2 - A] | |
| Ossein gelatin | 52.2 g |
| Distilled water | 6180 ml |
| Polyisopropylene-polyethyleneoxy-disuccinic acid ester sodium salt 10% ethanolic aqueous solution | 6.5 ml |
| 4-Hydroxy-6-methyl-1,3,3a,7-tetra-azaindene | 225 mg |
| $NH_4OH$ | 1.76 mole |
| Seed emulsion EM - 8 | 320 ml |
| [Solution 2 - B] | |
| $AgNO_3$ | 1223.1 g |
| $NH_4OH$ | 15.12 mole |
| Made up to 2400 ml with addition of distilled water. | |
| [Solution 2 - C] | |
| Ossein gelatin | 48 g |
| KBr | 428.4 g |
| NaCl | 210.3 g |
| Polyisopropylene-polyethyleneoxy-disuccinic acid ester sodium salt 10% ethanolic aqueous solution | 4.8 ml |
| 4-Hydroxy-6-methyl-1,3,3a,7-tetra-azaindene | 822 mg |
| Made up to 2400 ml with addition of distilled water. | |
| [Solution 2 - D] | |
| KBr | 0.474 g |
| NaCl | 58.3 g |
| Made up to 1000 ml with addition of distilled water. | |
| [Solution 2 - E] | |
| 56% Acetic acid solution | 2000 ml |

At 40° C., by means of a mixing stirrer as disclosed in Japanese Patent Publication Nos. 58288/1983 and 58289/1983, the solution 2 - A was mixed with the solution 2 - B and the solution 2 - C according to the double jet method. The addition rate of the solution 2 - B was increased like a polygonal line with lapse of time as shown in Table 3. Further, between the addition of each solution, pAg of the mixed solution was controlled to 8.4 by using the solution 2 - D, and by using the solution 2 - E, pH of the mixed solution was so controlled as to decrease with lapse of time as shown in Table 3. The control of the addition rates of the solutions 2 - B, 2 - C, 2 - D and 2 - E was carried out by using a flow rate variable roller tube pump.

Two minutes after completion of the addition of the solution 2 - B and the solutoin 2 - C, pH of the emulsion was adjusted to 6.0 with addition of the solution 2 - E. Then, washing and desalting of the emulsion were carried out by the following procedures. To the emulsion were added 1300 ml of 5% Demol N (trade name, produced by Kao Atlas K.K.) aqueous solution and 1300 ml of 20% aqueous mangesium sulfate solution to cause aggregation of the emulsion, and the aggregate was sedimented by allowed to stand. Subsequently, the supernatant was decanted and 12300 ml of distilled water was added thereto in order to disperse again.

Then, 400 ml of 20% aqueous magnesium sulfate solution was added to the emulsion to cause aggregation again and the aggregate was sedimented, followed by decantation of the supernatant. To the aggregate was added 800 ml of an aqueous solution of ossein gelatin (containing 80 g of ossein gelatin) and the mixture was stirred at 40° C. for 20 minutes to form dispersion and the total amount was made 5000 ml with addition of distilled water.

This emulsion is hereinafter called as EM - 15.

TABLE 3

| Addition time (min) | Addition rate of solution 2-B (ml/min) | pH |
|---|---|---|
| 0.0 | 8.4 | 8.50 |
| 10.9 | 16.9 | 8.44 |
| 20.5 | 30.5 | 8.34 |
| 25.7 | 37.7 | 8.26 |
| 30.0 | 43.6 | 8.12 |
| 35.6 | 51.8 | 8.06 |
| 40.4 | 59.0 | 7.94 |
| 44.1 | 61.1 | 7.84 |
| 47.7 | 60.3 | 7.74 |
| 52.2 | 57.8 | 7.62 |
| 57.0 | 54.0 | 7.50 |

By referring the above preparative method, emulsions EM - 7 to EM - 16 of the present invention were prepared.

EM - 1 to EM - 6 as comparative purpose were also prepared according to the nutral method.

In Table 4, molar % of pottasium bromide in the halide solution to be used for preparation of the emulsion, an average grain diameter, seed emulsions to be used and crystal habits are shown. EM - 4 and EM - 5 were prepared in accordance with Japanese Provisional Patent Application No. 5423/1973. Further, EM - 10 to EM - 12 are core-shell emulsion having different silver bromide contents of the core and the shell.

TABLE 4

| | KBr mole % in solution C | Seed emulsion used | Average grain diameter (μm) | Crystal habits |
|---|---|---|---|---|
| EM - 1 | 90 | NE - 1 | 0.40 | cubic |
| EM - 2 | 50 | NE - 2 | 0.40 | " |
| EM - 3 | 15 | NE - 3 | 0.41 | " |
| EM - 4 | 50 | NE - 2 | 0.40 | dodecahedron |
| EM - 5 | 50 | EM - 2 | 1.01 | " |
| EM - 6 | 50 | EM - 2 | 1.00 | cubic |
| EM - 7 | 90 | NE - 1 | 0.40 | crystals having (nnl) faces |
| EM - 8 | 50 | NE - 2 | 0.40 | crystals having (nnl) faces |
| EM - 9 | 15 | NE - 3 | 0.40 | crystals having (nnl) faces |
| EM - 10 | 15 | NE - 1 | 0.41 | crystals having (nnl) faces |
| EM - 11 | 15 | NE - 4 | 0.41 | crystals having (nnl) faces |
| EM - 12 | 90 | NE - 3 | 0.40 | crystals having (nnl) faces |
| EM - 13 | 90 | EM - 7 | 1.03 | crystals having (nnl) faces |

TABLE 4-continued

| | KBr mole % in solution C | Seed emulsion used | Average grain diameter (μm) | Crystal habits |
|---|---|---|---|---|
| EM - 14 | 90 | EM - 1 | 0.96 | crystals having (nnl) faces |
| EM - 15 | 50 | EM - 8 | 1.04 | crystals having (nnl) faces |
| EM - 16 | 50 | EM - 2 | 1.03 | crystals having (nnl) faces |

The electron microscopic photographs of the silver halide grains in the EM - 6, 13, 14, 15 and 16 are shown in FIGS. 9 to 13.

EXAMPLE 2

Silver chlorobromide emulsions EM - 1 to 4, 7 to 10 and 12 were effected to chemical sensitization and light-sensitive materials Samples No. 101 to No. 109 were prepared.

Chemical sensitization was carried out by adding sodium thiosulfate to 0.353 mole of each emulsion with optimum conditions. The above each emulsion and an aqueous gelatin solution were mixed and 20 mg of 1,3,5-triacryloyl-hexahydro-S-triazine - 3% methanol solution was added per g of gelatin as a hardener. The mixture was then applied on a support so as to become a silver amount of 3.0 g/m$^2$ and a gelatin amount of 12 g/m$^2$. The samples thus obtained was exposed through optical wedge and then the following processings were carried out.

| | |
|---|---|
| Developing solution (20° C.; 10 minutes) | |
| 1. Water (about 50° C.) | 750 cc |
| 2. Methol | 2 g |
| 3. Anhydrous sodium sulfite | 100 g |
| 4. Hydroquinone | 5 g |
| 5. Borax | 2 g |
| 6. Made up to total amount of 1000 cc with the addition of water. | |
| Development stopping solution (1 minute) | |
| 1. Water | 1000 cc |
| 2. Acetic acid (28%) | 125 cc |
| (Glacial acetic acid) | (35 cc) |
| Fixing solution (20° C.; 15 minutes) | |
| 1. Water | 600 cc |
| 2. Sodium thiosulfate (hypo) | 240 g |
| 3. Anhydrous sodium sulfite | 15 g |
| 4. Acetic acid (28%) | 48 cc |
| (Glacial acetic acid may be used) | (13.4 cc) |
| 5. Boric acid | 7.5 g |
| 6. Powdery potassium alumite | 15 g |
| 7. Made up to total amount of 1000 cc with the addition of water. | |
| Washing (5 minutes) | |

Each sample obtained was carried out with the conventional method sensitometry evaluation.

The obtained results are shown in Table 5. In the table, sensitivity is an inverse number of the exposed amount providing a concentration of fog +0.3 on a sensitometry curve, and is shown by the relative value when the sensitivity of Comparative Sample No. 101 as 100.

TABLE 5

| Sample No. | Emulsion: Emulsion No. | Emulsion: Crystal habits | Sensitometry characteristics: Sensitivity | Sensitometry characteristics: Fog |
|---|---|---|---|---|
| 101 | EM - 1 | cubic | 100 | 0.10 |
| 102 | EM - 2 | " | 100 | 0.11 |
| 103 | EM - 3 | " | 100 | 0.12 |
| 104 | EM - 4 | rhombo-decahedron | 90 | 0.05 |
| 105 | EM - 7 | crystal having (nnl) faces | 125 | 0.04 |
| 106 | EM - 8 | crystal having (nnl) faces | 127 | 0.04 |
| 107 | EM - 9 | crystal having (nnl) faces | 130 | 0.05 |
| 108 | EM - 10 | crystal having (nnl) faces | 128 | 0.05 |
| 109 | EM - 12 | crystal having (nnl) faces | 128 | 0.05 |

As seen from Table 5, Sample No. 104 disclosed in Japanese Provisional Patent Publication No. 5423/1973 is superior to Sample No. 101 used the silver chlorobromide emulsion comprising (100) faces in fog, but it has disadvantage of low in attained sensitivity. On the other hand, Samples No. 105 to No. 109 of the present invention show equivalent or less in fog as compared with Sample No. 104 and have high in attained sensitivity.

Accordingly, it can be understood that the emulsions of the present invention are extremely excellent in fog-sensitivity relationship.

EXAMPLE 3

To 0.353 mole of silver chlorobromide emulsions EM - 1 to 4, 7 to 10 and 12 prepared in Example 1 were added 100 mg of sensitizing dye (Compound A shown below) and sodium thiosulfate, and chemical sensitization was carried out with optimum conditions.

Next, separately from the above, 515 g of yellow coupler (Compound B shown below) was dissolved under heating in a mixed solution of 310 g of dioctylphthalate and 1150 ml of ethyl acetate at 60° C., and the resulting solution was added to 500 ml of 40° C. aqueous solution containing 400 g of gelatin and 25.5 g of sodium dodecylbenzene sulfonate. After the mixture was vigorously stirred with homogenizer and dispersed, the total amount was made to 7500 ml with water to prepare an emulsified dispersion of a coupler.

To each emulsion carried out the above sensitization was added and mixed each 1500 ml of the above emulsified dispersion of the coupler, and then 17 mg of sodium 2,4-dichloro-6-hydroxy-S-triazine was added per g of gelatin as a hardener. The mixture was applied on a polyethylene resin coated paper so as to become a silver amount of 0.3 g/m$^2$ to prepare Samples No. 201 to No. 209.

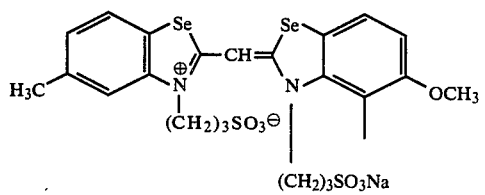

Compound A

-continued

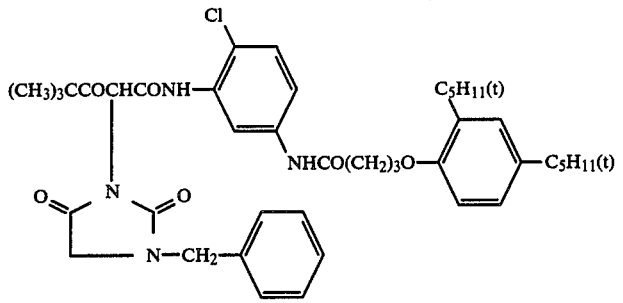

Compound B

The above Samples were exposed through optical wedge and processed by the following steps.

| Processing steps | |
|---|---|
| Color developing | 3 minutes |
| Bleach-fixing | 1 minute |
| Washing | 1 minute |
| Drying | 60° C. to 80° C. for 2 minutes |

Compositions of each processing solution are as follows:

| | |
|---|---|
| [Color developing solution] | |
| Pure water | 800 ml |
| Benzyl alcohol | 15 ml |
| Hydroxyamine sulfate | 2.0 g |
| Potassium bromide | 1.5 g |
| Sodium chloride | 1.0 g |
| Potassium sulfite | 2.0 g |
| Triethanol amine | 2.0 g |
| N—ethyl-N—β-methanesulfone-amidoethyl-3-methyl-4-amino-aniline sulfate | 4.5 g |
| 1-Hydroxyethylidene-1,1-diphosphonic acid (60% aqueous solution) | 1.5 ml |
| Potassium carbonate | 32 g |
| Whitex BB (50% aqueous solution) (Fluorescent brightening agent, trade name, produced by Sumitomo Kagaku Kogyo Co., Ltd.) | 2 ml |
| Made up to 1 l with addition of water and adjusted to pH 10.2 with 20% potassium hydroxide or 10% dilute sulfric acid. | |
| [Bleach-fixing solution] | |
| Pure water | 550 ml |
| Ethylenediaminetetraacetic acid iron (II) ammonium salt | 65 g |
| Ammonium thiosulfate | 85 g |
| Sodium hydrogen sulfite | 10 g |
| Sodium metabisulfite | 2 g |
| Ethylenediaminetetraacetic acid disodium salt | 20 g |
| Sodium bromide | 10 g |
| Made up to 1 l with addition of water and adjusted to pH = 7.0 with ammonia or 10% dilute sulfric acid. | |

In the same manner as in Example 1, sensitometry evaluation was carried out. Fog, sensitivity and gradation are shown below. In the table, sensitivity is the same as in Example 1, an inverse number of the exposed amount providing a concentration of fog+0.3, and is shown by the relative value when the sensitivity of Comparative Sample No. 201 as 100.

Gradation is a gradient of a portion corresponding to the reflective concentration of 0.8 to 1.8 on the sensitometry.

TABLE 6

| | Emulsion | | Sensitometry characteristics | | |
|---|---|---|---|---|---|
| Sample No. | Emulsion No. | Crystal habits | Sentivity | Fog | Gradation |
| 201 | EM - 1 | cubic | 100 | 0.05 | 3.11 |
| 202 | EM - 2 | " | 100 | 0.05 | 3.09 |
| 203 | EM - 3 | " | 100 | 0.06 | 3.09 |
| 204 | EM - 4 | rhombo-decahedron | 88 | 0.02 | 3.15 |
| 205 | EM - 7 | crystal having (nnl faces) | 131 | 0.02 | 3.48 |
| 206 | EM - 8 | crystal having (nnl) faces | 129 | 0.02 | 3.50 |
| 207 | EM - 9 | crystal having (nnl) faces | 130 | 0.02 | 3.46 |
| 208 | EM - 10 | crystal having (nnl) faces | 131 | 0.02 | 3.48 |
| 209 | EM - 12 | crystal having (nnl) faces | 130 | 0.02 | 3.31 |

As seen from the above results, it can be understood that in the emulsions which were effected to spectral sensitization, the emulsions of the present invention (Samples No. 205 to No. 209) are excellent in fog-sensitivity relationship as compared with the conventional silver chlorobromide emulsion comprising (100) faces (Samples No. 201 to No. 203) and the silver chlorobromide emulsion having rhombodecahedral shape comprising (110) faces (Sample No. 204). Further, it can be understood that in the present invention, extremely hard tone in gradation can be obtained.

When the results in Table 6 are further investigated in detail, the emulsions EM - 7, 8 and 9 of the present invention show substantially the same photographic characteristics while the silver bromide amounts are different, and have extremely excellent characteristics in the points of fog - sensitivity - gradation as compared with the conventional emulsions.

Further, while the emulsions EM - 10 and 12 of the present invention (corresponding to the light-sensitive material Samples No. 208 and No. 209) are so-called coreshell type grains which are different in silver bromide content of silver halide grains between the center portion and the surface portion of the grains, they have substantially the same photographic characteristics with the emulsions EM - 7, 8 and 9 of the present invention which have uniform silver bromide content of the silver halide grains.

Thus, even if the silver bromide content of the emulsions is different or its distribution in the grains is different, the above results show that the silver halide grains having (nnl) faces are suitable for the object of the present invention.

We claim:

1. Silver halide grains, having crystal faces defined by Miller indices of (nn1) where n ≧2 and comprising a silver halide composition consisting substantially of silver chlorobromide.

2. Silver halide grains according to claim 1, wherein a proportion of a surface area of the (nn1) faces to the total surface area is at least 30%.

3. Silver halide grains according to claim 1, wherein said silver chlorobromide comprises 1 to 99 mole % of silver chloride and 99 mole % or less of silver bromide.

4. Silver halide grains according to claim 1, wherein said grains have a shape selected from the group consisting of trisoctahedron, trisdecahedron, tetraoctahedron and octatridecahedron each having (nn1) faces.

5. A light-sensitive silver halide photographic material having light-sensitive silver halide emulsion layers on a support, which comprises at least one of said light-sensitive silver halide emulsion layers contain silver halide grains having crystal faces defined by Miller indices of (nn1) where n≧2 and comprising a silver halide composition consisting substantially of silver chlorobromide.

6. A light-sensitive silver halide photographic material according to claim 5, wherein a proportion of a surface area of the (nn1) faces to the total surface area is at least 30%.

7. A light-sensitive silver halide photographic material according to claim 5, wherein said silver chlorobromide comprises 1 to 99 mole % of silver chloride and 99 mole % or less of silver bromide.

8. A light-sensitive silver halide photographic material according to claim 5, wherein said grains have a shape selected from the group consisting of trisoctahedron, trisdecahedron, tetraoctahedron and octatridecahedron each having (nn1) faces.

* * * * *